US008303090B2

(12) United States Patent
Nishikawa

(10) Patent No.: US 8,303,090 B2
(45) Date of Patent: Nov. 6, 2012

(54) LIQUID DISCHARGE APPARATUS AND METHOD FOR PRODUCING THE SAME

(75) Inventor: Tatsuya Nishikawa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 144 days.

(21) Appl. No.: 12/856,739

(22) Filed: Aug. 16, 2010

(65) Prior Publication Data

US 2011/0073674 A1 Mar. 31, 2011

(30) Foreign Application Priority Data

Sep. 30, 2009 (JP) ..... 2009-227890

(51) Int. Cl.
*B41J 2/14* (2006.01)

(52) U.S. Cl. ..... 347/50

(58) Field of Classification Search ..... 347/50, 347/58, 68, 70–72; 29/825
See application file for complete search history.

(56) References Cited

U.S. PATENT DOCUMENTS 7,753,489 B2 * 7/2010 Imai et al. ..... 347/50
2006/0125091 A1 6/2006 Imai et al.

FOREIGN PATENT DOCUMENTS

JP 2006-088630 4/2006

* cited by examiner

*Primary Examiner* — An Do
(74) *Attorney, Agent, or Firm* — Frommer Lawrence & Haug LLP

(57) ABSTRACT

A method for producing a liquid discharge apparatus is provided, including preparing a liquid discharge head including driving sections which apply a discharge pressure to a liquid; preparing a wiring board including a base board having lands formed on a surface and thermally expandable members arranged in hollow portions of the base board; forming terminals on electrodes of the liquid discharge head; making the lands be in contact with the terminals while securing a space between the liquid discharge head and the wiring board; making a heater to abut against areas of the wiring board arranged with the thermally expandable members; and heating the thermally expandable members by the heater so that the thermally expandable members are expanded to be brought in contact under pressure with the terminals.

6 Claims, 6 Drawing Sheets

LIQUID DISCHARGE APPARATUS AND METHOD FOR PRODUCING THE SAME

CROSS REFERENCE TO RELATED APPLICATION

The present application claims priority from Japanese Patent Application No. 2009-227890, filed on Sep. 30, 2009, the disclosure of which is incorporated herein by reference in its entirety.

BACKGROUND OF THE INVENTION

1. Field of the Invention

The present invention relates to a liquid discharge apparatus provided with a liquid discharge head which has a driving section to be driven so that the discharge pressure is applied to a liquid in order to discharge the liquid from a nozzle and a wiring board which is connected to the liquid discharge head, and a method for producing the same.

2. Description of the Related Art

For example, an ink discharge apparatus such as an ink jet printer is known as the liquid discharge apparatus provided with the liquid discharge head. A certain ink discharge apparatus is provided with an ink-jet head which has nozzles and driving sections for discharging an ink from the nozzles, and a flexible wiring board which is connected to the ink jet head. Electrodes, which correspond to the driving sections, are formed on a surface of the ink-jet head. Lands, which face terminals electrically connected to the electrodes, are formed on a surface of the flexible wiring board. The terminals are formed of a conductive adhesive and have a bump-shaped form. The lands are brought in contact with the terminals, and thus the electrodes and the lands are electrically connected to one another.

SUMMARY OF THE INVENTION

In the case of the ink discharge apparatus described above, the electrodes and the lands are electrically connected to one another by pressing the lands against the bump-shaped terminals. However, it is not easy to appropriately adjust the force for pressing the land against the terminal. If the force is too strong, the terminal is excessively squashed or crushed. Therefore, it is feared that any portion of the flexible wiring board other than the land may be brought in contact with the surface of the ink-jet head, and the operation of the driving section may be inhibited. On the other hand, if the force is too weak, it is impossible to sufficiently secure the contact area between the land and the terminal. Therefore, it is feared that the electrical connection failure may be caused.

The present invention has been made in order to solve the foregoing problem, an object of which is to provide a liquid discharge apparatus and a method for producing the same wherein it is possible to avoid the inhibition of the operation of the driving section and it is possible to avoid the electrical connection failure between the land and the terminal.

According to a first aspect of the present invention, there is provided a method for producing a liquid discharge apparatus which discharges a liquid, including:

preparing a liquid discharge head including a channel unit formed with nozzles through which the liquid is discharged and channels for the liquid, and driving sections which have electrodes corresponding to the nozzles and which are driven so that a driving signal is applied to the electrodes to apply a discharge pressure to the liquid in the channel;

preparing a wiring board including a base board, lands which are formed on a first surface of the base board, and thermally expandable members which are arranged in hollow portions formed in the base board at land-portions at which the lands are formed;

forming bump-shaped terminals with a conductive material on the electrodes of the liquid discharge head;

bringing the lands in contact with the terminals while securing a space between the wiring board and driving areas, of the liquid discharge head, which are deformable in accordance with the driving of the driving sections of the liquid discharge head;

heating the thermally expandable members from a side of a second surface disposed on a side opposite to the first surface facing the liquid discharge head.

In this procedure, the thermally expandable members may be heated by, for example, the heater. Then, the heater may be allowed to abut against at least the areas in which the thermally expandable members are arranged, of the surface of the wiring board disposed on the side opposite to the side of the liquid discharge head, and the heater may be fixedly held. Therefore, when the thermally expandable members are heated, the thermally expandable members can be expanded toward the side opposite to the heater side (i.e., toward the terminal side). The lands can be reliably pushed to abut against the terminals by means of the thermally expandable members. When the terminals are formed of the thermosetting adhesive, the thermally expandable members and the thermosetting adhesive may be heated by the heater so that the thermosetting adhesive is cured after the thermally expandable members are expanded to bring the lands in contact under pressure with the terminals. Therefore, the "connecting the lands and the terminals electrically and physically" and the "curing the thermosetting adhesive" can be performed easily and quickly in one step.

According to a second aspect of the present invention, there is provided a liquid discharge apparatus which discharges a liquid, including:

a liquid discharge head including a channel unit which is formed with nozzles through which the liquid is discharged and channels for the liquid, and a driving sections which have electrodes corresponding to the nozzles and which are driven so that a driving signal is applied to the electrodes to apply a discharge pressure to the liquid in the channel;

bump-shaped terminals which are formed of a conductive material having conductivity and which are arranged on the electrodes; and a wiring board including a base board which is arranged to face a surface of the liquid discharge head formed with the electrodes and in which hollow portions are formed at portions, of the base board, facing the terminals, thermally expandable members provided in the hollow portions of the base board, and lands which are formed, on a first surface of the base board facing the liquid discharge head, to face the terminals and which covers at least a part of the thermally expandable members;

wherein the terminals are provided at positions shifted from positions overlapped with the driving sections as viewed in a direction perpendicular to a surface of the liquid discharge head on which the electrodes are formed; and the lands are extruded toward the liquid discharge head as compared with surroundings of the lands so that the lands abut against the terminals.

In this arrangement, the lands are allowed to abut against the terminals by being pushed or pressed by the thermally expandable members. Therefore, the lands and the terminals can be reliably brought in contact with each other, and it is possible to avoid the electrical connection failure between the lands and the terminals. Further, the lands are extruded toward the liquid discharge head as compared with the surroundings thereof by being pushed or pressed by the thermally expandable members, and the lands are allowed to abut against the terminals. Therefore, it is possible to reliably prevent the surroundings of the lands from being brought in contact with the driving areas of the liquid discharge head.

According to the present teaching, the lands of the wiring board can be pushed to abut against the terminals by means of the thermally expandable members while securing the space between the driving areas and the wiring board. Therefore, it is possible to avoid the electrical connection failure between the lands and the terminals. Further, it is possible to prevent any part of the wiring board from being brought in contact with the driving areas. It is possible to stabilize the operation of the driving sections.

BRIEF DESCRIPTION OF THE DRAWINGS

FIG. 6 shows steps illustrating a "method for producing the ink discharge apparatus" according to the first embodiment, wherein

DESCRIPTION OF THE PREFERRED EMBODIMENTS

An explanation will be made below with reference to the drawings about a "liquid discharge apparatus" and a "method for producing the liquid discharge apparatus" according to a preferred embodiment of the present teaching.

First Embodiment

Figure 1:
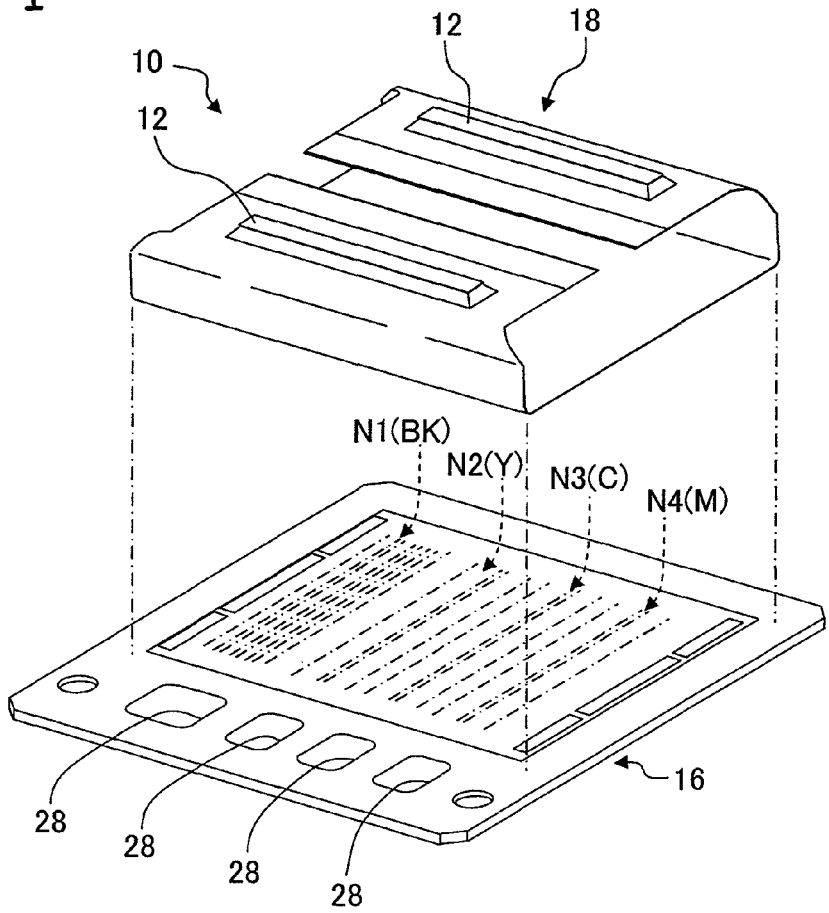
FIG. 1 shows an exploded perspective view illustrating an arrangement of an "ink discharge apparatus" according to a first embodiment.

As shown in FIG. 1, an ink discharge apparatus 10 selectively discharges four color inks of black (BK), yellow (Y), cyan (C), and magenta (M) from a plurality of nozzles 14 (FIG. 2) toward a discharge objective such as the printing paper or the like (not shown) on the basis of the driving signal outputted from two driver IC's 12. In this arrangement, the ink discharge apparatus 10 principally includes an ink discharge head 16 which is provided as the "liquid discharge head", terminals 40, and a wiring board 18.

Figure 2:
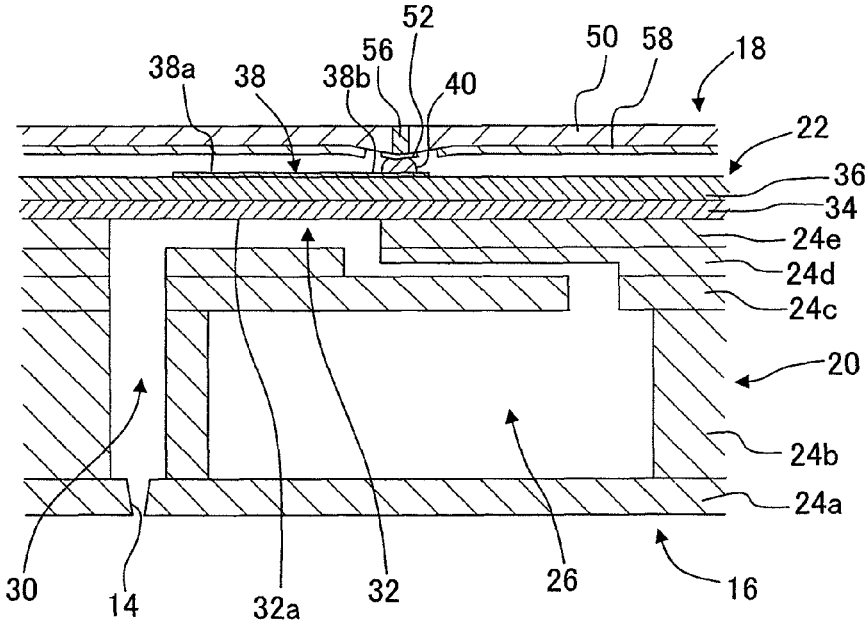
FIG. 2 shows a partial sectional view illustrating the arrangement of the "ink discharge apparatus" according to the first embodiment.

As shown in FIG. 2, the ink discharge head 16 includes a channel unit 20 and an actuator unit 22. The channel unit 20 is constructed by staking five plates 24*a* to 24*e*. The plates 24*a* to 24*e* are stacked so that "recesses" or "through-holes", which are formed for the plates 24*a* to 24*e*, are communicated with each other. Accordingly, four ink channels N1 to N4 (FIG. 1) are constructed corresponding to the ink colors. As shown in FIG. 2, each of the ink channels N1 to N4 has a manifold 26 which pools or stores the ink, an ink supply port 28 (FIG. 1) which supplies the ink to the manifold 26, a plurality of nozzles 14 through which the ink contained in the manifold 26 is discharge to the outside, and a plurality of individual channels 30 via which the manifold 26 is communicated with the plurality of nozzles 14. A plurality of pressure chambers 32, each of which is individually communicated with one of the nozzles 14, is provided for the plurality of individual channels 30, respectively.

Figure 3:
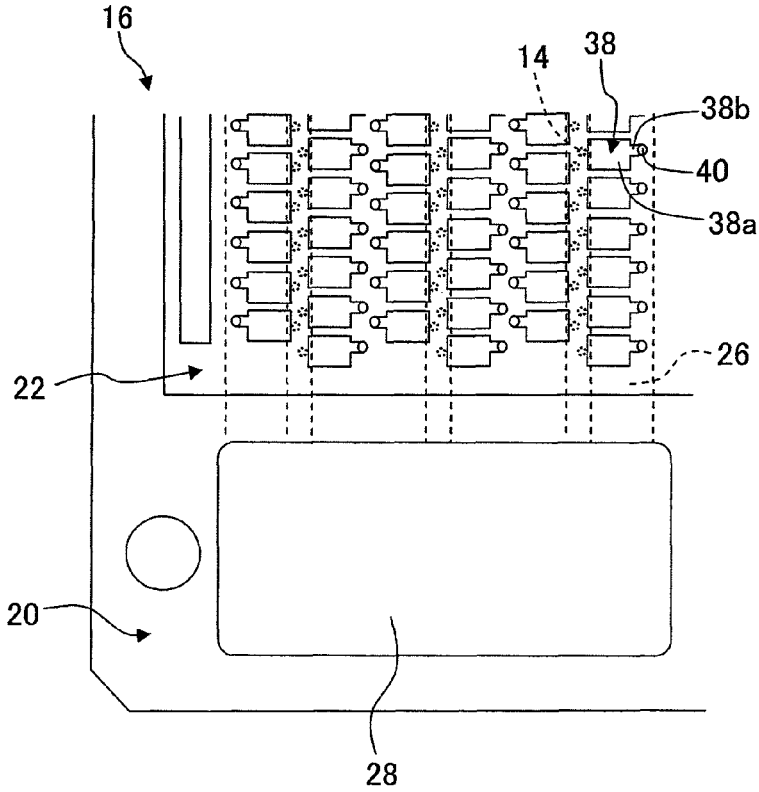
FIG. 3 shows a partial enlarged plan view illustrating an arrangement of an "ink discharge head" of the "ink discharge apparatus" according to the first embodiment.

On the other hand, as shown in FIG. 2, the actuator unit 22 defines an upper surface 32*a* of the pressure chambers 32 of the channel unit 20. Further, the actuator unit 22 selectively applies the discharge pressure to the ink in each of the pressure chambers 32. The actuator unit 22 has a vibration plate 34, a piezoelectric layer 36, and a plurality of electrodes 38 which correspond to the plurality of nozzles 14 respectively. The vibration plate 34 is formed of a conductive material. The vibration plate 34 is joined to the upper surface of the channel unit 20 so as to cover the plurality of pressure chambers 32. The piezoelectric layer 36 is formed of a piezoelectric material containing a main component of lead titanate zirconate (PZT). The piezoelectric layer 36 is polarized in the thickness direction thereof. Each of the electrodes 38 is formed of a conductive material. As shown in FIG. 3, each of the electrodes 38 has an electrode body 38*a* which is arranged on the surface of the actuator unit 22 at a facing position facing the pressure chamber 32 (FIG. 2), and a terminal portion 38*b* which is arranged at a position deviated from the facing position. The bump-shaped terminal 40, which is composed of a thermosetting adhesive having the conductivity, is formed on a surface of the terminal portion 38*b*. For example, "Dohdent NH-070A (T)" (trade name) produced by NIHON HANDA Co., Ltd. can be used as the thermosetting adhesive.

Figure 4:
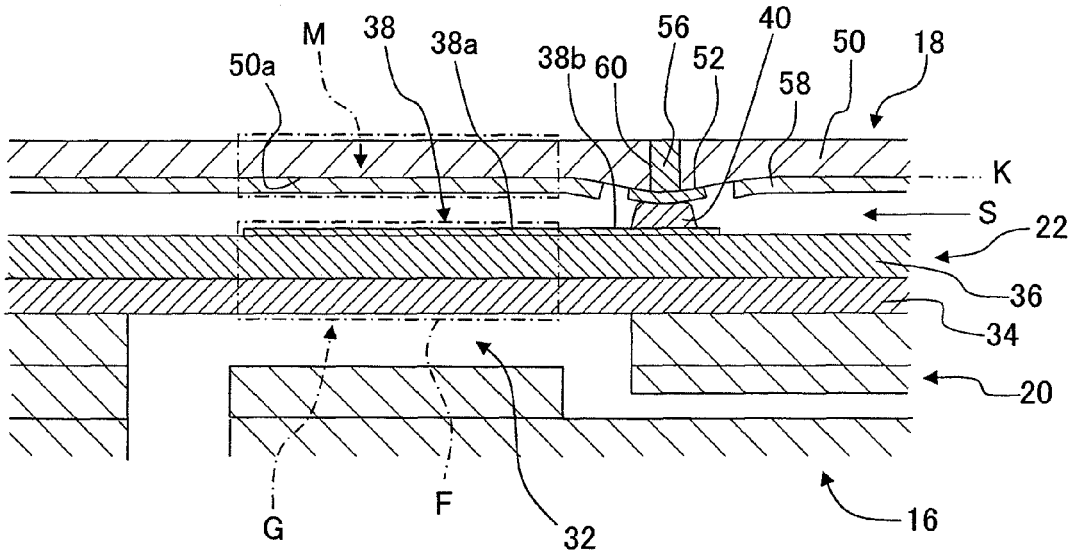
FIG. 4 shows a sectional view illustrating an arrangement of main components of the "ink discharge apparatus" according to the first embodiment.

In the actuator unit 22, as shown in FIG. 4, the electrode body 38*a*, the portion of the vibration plate 34 facing the electrode body 38*a*, and the portion of the piezoelectric layer 36 interposed between the electrode body 38*a* and the vibration plate 34 form the "driving section F" which is driven on the basis of the driving signal applied to the electrode 38. The actuator unit 22 according to this embodiment has the so-called "unimorph structure". The driving section F can be displaced toward one side in the thickness direction of the piezoelectric layer 36, for example, by generating the electric potential difference between the electrode 38 and the vibration plate 34 to generate the electric field in the thickness direction of the piezoelectric layer 36. The displacement of the driving section F can be restored to the original state by making the electric potential difference to be zero. In this way, the driving section F can be alternately displaced toward the both sides in the thickness direction by repeating the ON/OFF operation for the electric potential difference between the electrode 38 and the vibration plate 34. The driving section F includes the defining portion of the vibration plate 34 which defines the upper surface 32*a* of the pressure chamber 32 and the portion of the electrode body 38*a* which face the defining portion. The terminal portion 38*b* and the terminal 40 are positioned while being deviated from the position overlapped with the driving section F as viewed in the direction perpendicular to the in-plane direction of the actuator unit (in the direction parallel to the thickness direction of the piezoelectric layer 36).

Solder may be used as the material for constructing the terminal 40 in place of the thermosetting adhesive having the conductivity. Alternatively, it is also allowable to use any conductive material having no physical connecting function or no adhesive function (for example, silver alloy). However, when the terminal 40 is formed by the conductive material having no physical connecting function, it is necessary to use a connecting agent having an electroconductive property in combination in order to physically connect the ink discharge head 16 and the wiring board 18.

Figure 5:
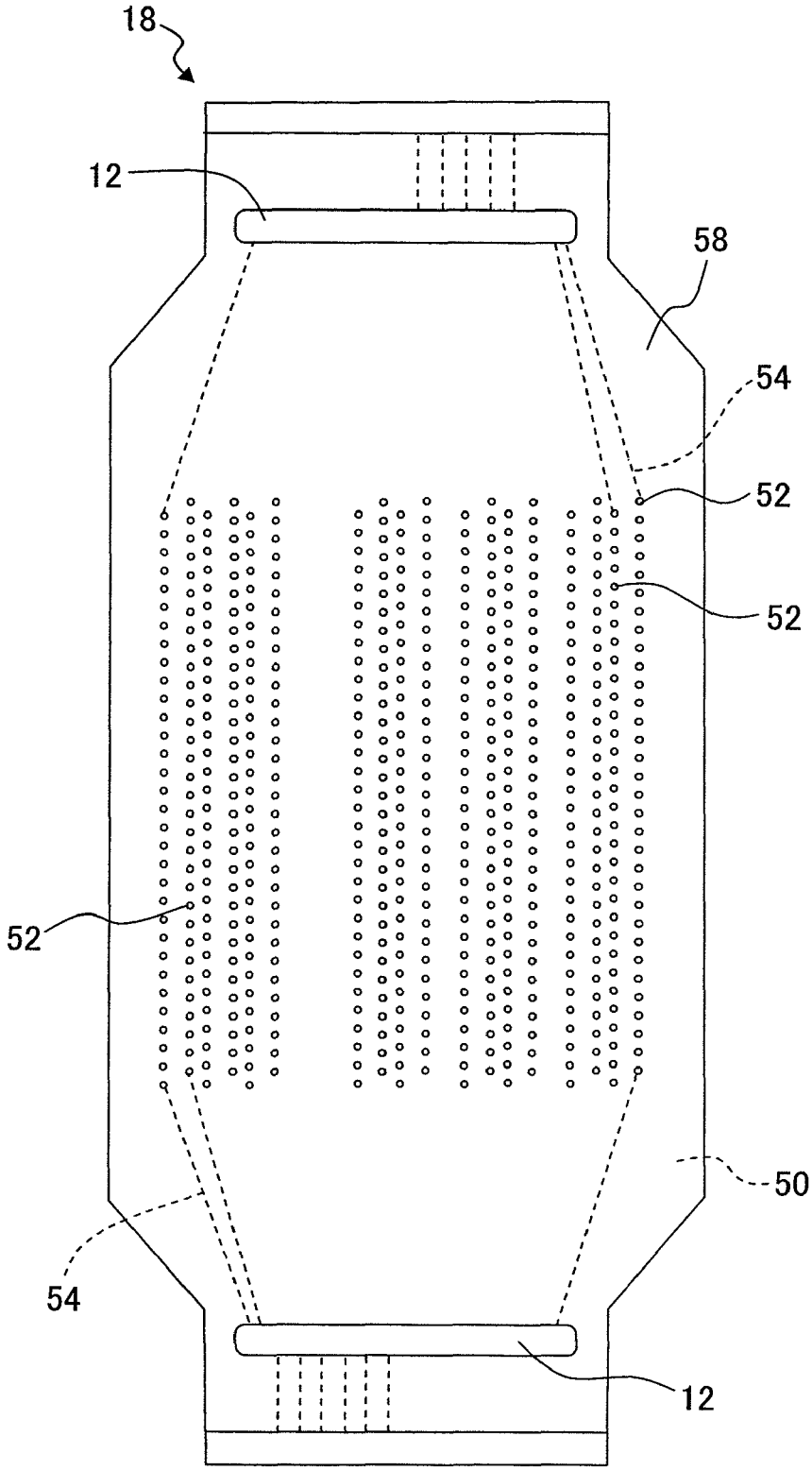
FIG. 5 shows a bottom view illustrating an arrangement of a "wiring board" of the "ink discharge apparatus" according to the first embodiment.

As shown in FIGS. 4 and 5, the wiring board 18 may be the so-called "COF (Chip On Film)". The wiring board 18 includes a base board 50, two driver IC's 12, a plurality of lands 52, a plurality of wiring lines 54, a plurality of thermally expandable members 56, and an insulating coating member 58.

The base board 50 is a sheet-shaped member formed of a flexible synthetic resin material such as a polyimide resin or the like. The base board 50 is arranged to face the surface of the ink discharge head 16 on which the electrodes 38 are formed. The two driver IC's 12 are mounted on a surface of the base board 50 (head-opposing surface 50*a*) disposed on the side of the ink discharge head 16. Further, those arranged on the head-opposing surface 50*a* of the base board 50 are the plurality of circular lands 52 which are formed of a conductive material such as a copper foil or the like, the plurality of wiring lines 54 which electrically connect any one of the two driver IC's 12 and the plurality of lands 52 respectively, and the insulating coating member 58 which covers the plurality of lands 52 and the plurality of wiring lines 54. When the wiring board 18 is attached to the ink discharge head 16, as shown in FIG. 1, the base board 50 are bent and folded so that the two driver IC's 12 are positioned over or above the ink discharge head 16. The shape of the land 52 is not limited to the circular shape, which may be, for example, any polygonal or elliptical shape.

As shown in FIG. 4, circular through-holes 60, which are provided as the hollow "empty portions", are formed in the base board 50 at portions facing the terminals 40, i.e., at portions, of the base board 50, positioned on a side of the lands 52 not facing the terminals 40. The columnar thermally expandable members 56 are provided in the through-holes 60. The thermally expandable member 56 has such a "property" that "the thermally expandable member 56 is expanded by being heated, but the thermally expandable member 56 is not restored to the original state even when the thermally expandable member 56 is cooled thereafter". In other words, the thermally expandable member 56 has such a property that the volume thereof is irreversibly increased by being heated. In this embodiment, the thermally expandable member 56 is constructed by using, for example, a resist or a polyimide resin having a multilayer structure which has a coefficient of thermal expansion larger than a coefficient of thermal expansion of the base board 50 and in which an increasing ratio of an expansion of the resist or the polyimide resin becomes maximum at a temperature higher than a curing temperature of the thermosetting adhesive for constructing the terminal 40. The increasing ratio of the expansion of the thermally expandable member at a certain temperature means the gradient of a graph indicating a temperature dependence of the volume of the thermally expandable member, at the certain temperature. Note that, the thermally expandable members 56 may be composed of a metal material such as an alloy or the like having a high coefficient of expansion. The thermally expandable members 56 may be either a liquid or a solid. Alternatively, the thermally expandable members 56 may be formed as porous members. The land 52 is extruded by the thermally expandable member 56 expanded by the heat to protrude toward the ink discharge head 16, and thus the land 52 abuts against the terminal 40. The force for pressing the land 52 against the terminal 40 is adjustable by appropriately changing, for example, the type, the size, and the heating temperature of the thermally expandable member 56.

The area of the ink discharge head 16, which is deformed in accordance with the driving of the driving section F, is herein defined as "driving area G". The area of the wiring board 18, which faces the driving area G, is herein defined as "facing area M". The virtual surface, of the base board 50 positioned in the facing area M, which includes the head-opposing surface 50*a*, is herein defined as "reference surface K". Based on this definition, as shown in FIG. 4, each of the plurality of lands 52 is allowed to abut against the terminal 40 by being extruded toward the ink discharge head 16 as compared with the reference surface K by means of the thermally expandable member 56 expanded by the heat. Therefore, it is possible to secure the space S between the facing area M of the wiring board 18 and the driving area G of the ink discharge head 16. It is possible to avoid the inhibition of the operation of the driving section F which would be otherwise caused such that the facing area M is brought in contact with the driving area G. When another member (for example, a protective layer) is formed integrally with the driving section F, the another member is also included in the "driving area G", because the another member is also deformed in accordance with the driving of the driving section F.

Figure 6A:
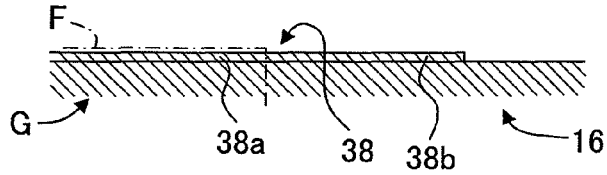
FIG. 6A shows a sectional view illustrating of preparing the ink discharge head.

When the ink discharge apparatus 10 is produced, as shown in FIG. 6A, the ink discharge head 16 is firstly prepared, which has the nozzles 14 for discharging the inks and the driving sections F having the electrodes 38 corresponding to the nozzles 14, the driving sections F being driven so that the discharge pressure is applied to the inks contained in the nozzles 14 by applying the driving signal to the electrodes 38.

Figure 6B:
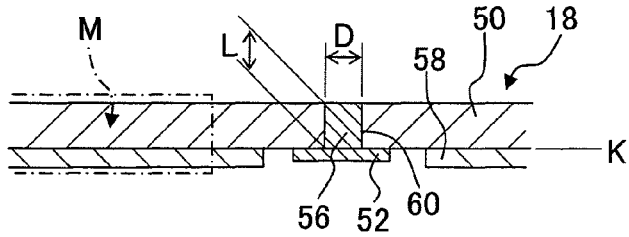
FIG. 6B shows a sectional view illustrating of preparing the wiring board.

Further, as shown in FIG. 6B, the wiring board 18 is prepared, which has the base board 50, the lands 50 which are formed on one surface of the base board 50, and the thermally expandable members 56 which are arranged in the through-holes 60 provided at the portions of the base board 50 formed with the lands 52. In the wiring board 18 prepared in this step, the length L of the thermally expandable member 56 is approximately the same as the length of the through-hole 60 formed through the base board 50. The lands 52 are arranged on the reference surface K described above. In this embodiment, the length L of the thermally expandable member 56 and the length of the through-hole 60 are about 38 μm, the diameter D of the through-hole 60 is about 140 to 150 μm, and the diameter of the land 52 is about 200 μm. The sizes are referred to merely by way of example, and the present teaching is not limited thereto. The length L of the thermally expandable member 56 may be set independently of the diameter D of the through-hole 60. However, the length L of the thermally expandable member 56 may be sufficiently longer than the diameter D, for example, in order to efficiently expand the thermally expandable member 56 in the direction directed to the terminal 40.

Figure 6C:
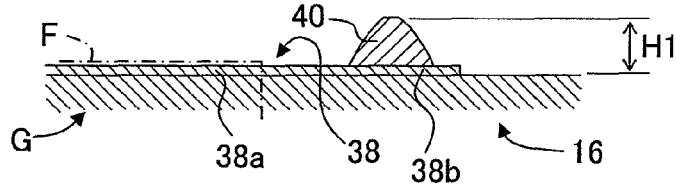
FIG. 6C shows a sectional view illustrating of forming terminals on electrodes.

When the preparation of the ink discharge head 16 and the wiring board 18 is completed, as shown in FIG. 6C, the bump-shaped terminals 40, which are composed of the conductive thermosetting adhesive, are formed on the electrodes 38 of the ink discharge head 16. In this step, the thermosetting adhesive, which constitutes the terminals 40, is not yet cured. The terminal 40 is formed so that the height H1 of the terminal 40 is sufficiently higher than the height H2 of the terminal 40 in the completed ink discharge apparatus 10 (see FIG. 6F). In this embodiment, the height H1 of the uncured terminal 40 is about 70 to 80 μm, and the height H2 of the terminal 40 after the curing is about 50 to 60 μm. The sizes of the heights H1, H2 of the terminals 40 are referred to merely by way of example, and the present teaching is not limited thereto.

Figure 6D:
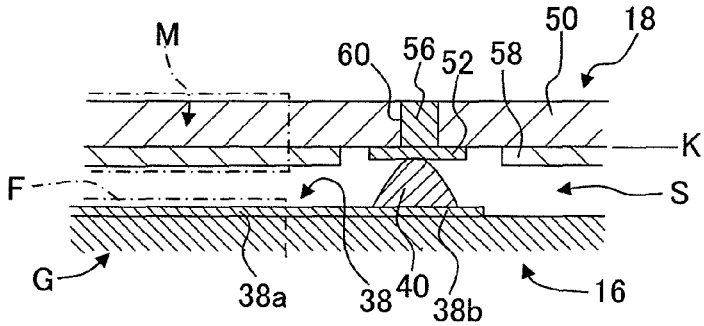
FIG. 6D shows a sectional view illustrating of bringing lands in contact with the terminals.

Subsequently, as shown in FIG. 6D, the lands 52 are brought in contact with the terminals 40 while securing the space S between the wiring board 18 (facing areas M) and the driving areas G to be deformed in accordance with the driving of the driving sections F of the ink discharge head 16. In other words, the ink discharge head 16 is fixed so that the surface, on which the electrodes 38 are formed, is directed upwardly. After that, the wiring board 18 is placed on the ink discharge head 16 so that the surface, on which the lands 52 are formed, is directed downwardly. The lands 52 are brought in contact with the uncured terminals 40 by utilizing the weight of the wiring board 18.

In this embodiment, the space S is secured by supporting the wiring board 18 by means of the uncured terminals 40. Therefore, the uncured terminal 40 is required to have a hardness to such an extent that the uncured terminal 40 is not squashed or crushed by the weight of the wiring board 18. On the other hand, if the terminal 40 is too hard, then the terminal 40 is hardly squashed in the step of FIG. 6F described later on, and hence it is impossible to sufficiently secure the contact area between the terminal 40 and the land 52. In view of the above, in this embodiment, the components of the thermosetting adhesive for constructing the terminal 40 are adjusted in order that the hardness of the terminal 40 is such a "hardness" that "the terminal 40 is not squashed by the weight of the wiring board 18 but the terminal 40 is squashed by the pressing force received by the thermally expandable member 56 expanded by the heat". For example, when the thermosetting adhesive is formed of a "base agent" for retaining the shape and a "conductive agent" for securing the conductivity, the blending ratio of the "base agent" is adjusted so that the hardness of the terminal 40 is the desired hardness as described above, because the larger the ratio of the "base agent" is, the higher the hardness is.

Figure 6E:
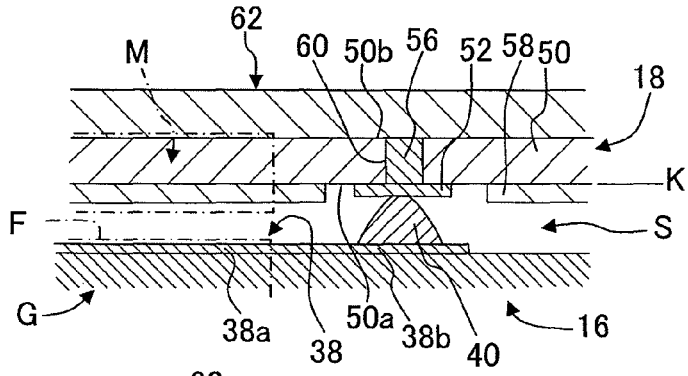
FIG. 6E shows a sectional view illustrating of allowing a heater to abut against the wiring board.

Subsequently, as shown in FIG. 6E, the heater 62 is fixedly held such that the heater 62 is allowed to abut against at least the areas, of the surface of the wiring board 18 disposed on the side opposite to the surface facing the ink discharge head 16, in which the thermally expandable members 56 are arranged. In this step, the heater 62 is arranged so that the portions of the wiring board 18, at which the thermally expandable members 56 are arranged, are pressed from the surface 50*b*, of the base board 50, disposed on the side opposite to the head-facing surface 50*a*. Therefore, the direction, in which the thermally expandable members 56 are expanded, can be regulated to the "direction directed to the terminals 40" by means of the heater 62. In the step shown in FIG. 6F, the lands 52 can be reliably pressed to abut against the terminals 40.

Figure 6F:
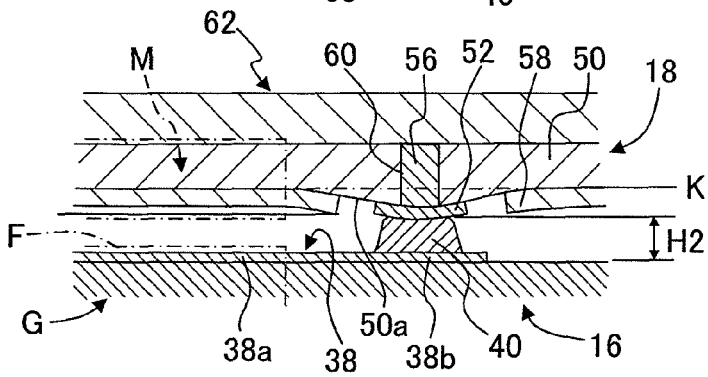
FIG. 6F shows a sectional view illustrating of expanding thermally expandable members.

When holding the heater 62 fixedly is completed, as shown in FIG. 6F, the thermally expandable members 56 and the thermosetting adhesive are heated by the heater 62 so that the thermosetting adhesive of the terminals 40 is cured after the thermally expandable members 56 are expanded to bring the lands 52 in contact under pressure with the terminals 40. In this embodiment, the coefficient of thermal expansion of the thermally expandable member 56 is greater than the coefficient of thermal expansion of the base board 50. Therefore, although the thermally expandable members 56 and the base board 50 are simultaneously heated, the lands 52, which are formed on the head-opposing surface 50*a*, can be extruded from the reference surface K by means of the thermally expandable members 56 having the high coefficient of thermal expansion, and the lands 52 can be allowed to abut against the terminals 40. In this procedure, as shown in FIG. 6D, when the wiring board 18 is supported by means of the uncured terminals 40, the terminals 40 are allowed to abut against the lands 52. The lands 52 can be further extruded toward the terminals 40 by means of the thermally expandable members 56. Therefore, the lands 52 can be reliably allowed to abut against the terminals 40. In this embodiment, the lands 52 are further extruded by several μm toward the terminals 40 by means of the thermally expandable members 56 in comparison with the state in which the terminals 40 and the lands 52 are in abutment. In this embodiment, the diameter of the abutment portion (contact portion) between the land 52 and the terminal 40 is about 120 μm. Such a size is referred to merely by way of example, and the present teaching is not limited thereto. Further, the thermally expandable member 56 is formed of the material in which an increasing ratio of an expansion of the material becomes maximum at a temperature higher than the curing temperature of the thermosetting adhesive for constructing the terminal 40. Therefore, the heat, which is used for expanding the thermally expandable member 56, can be utilized as it is to efficiently cure the thermally expandable member 56 as described later on. Therefore, the "connecting the lands 52 and the terminals 40 electrically and physically" and the "curing the thermosetting adhesive" can be performed easily and quickly in one step.

The heater 62 is allowed to abut against the surface, of the wiring board 18, disposed on the side opposite to the surface facing the terminals 40. Therefore, the heat of the heater 62 is firstly used for heating the thermally expandable members 56, and then the heat is used for heating the terminals 40. If the heating temperature of the heater 62 is too high, the timing, at which the terminals 40 are heated, is too early. Therefore, it is feared that the terminals 40 may be cured before the thermally expandable members 56 are sufficiently expanded. On the other hand, if the heating temperature of the heater 62 is too low, it is feared that the thermally expandable members 56 cannot be expanded. In view of the above, in the step as shown in FIG. 6F, the heating temperature of the heater 62 is adjusted to completely fulfill the requirement that "the thermosetting adhesive of the terminals 40 is cured after the thermally expandable members 56 are expanded to bring the lands 52 in contact under pressure with the terminals 40".

Second Embodiment

Figure 7:
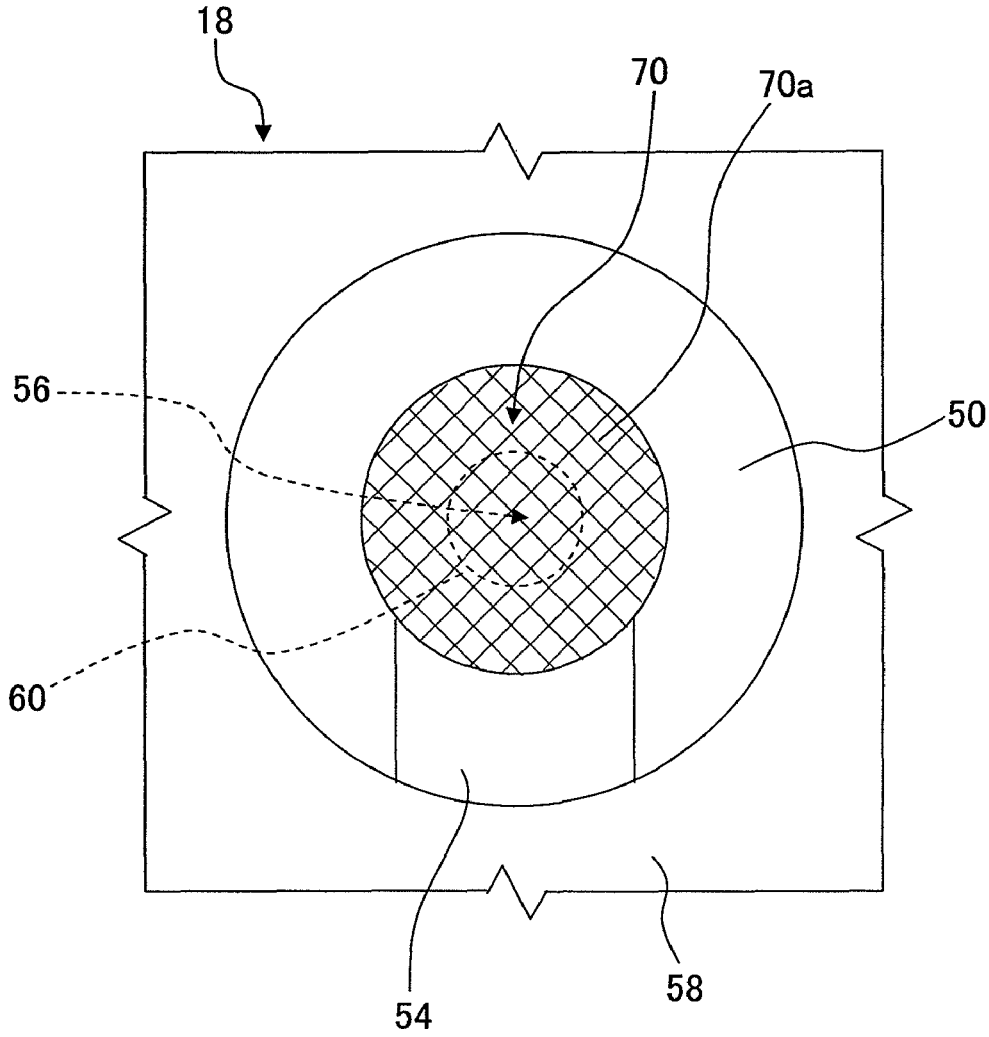
FIG. 7 shows a bottom view illustrating an arrangement of a "land" of an "ink discharge apparatus" according to a second embodiment.

In an ink discharge apparatus according to a second embodiment, the lands 52 of the wiring board 18 of the ink discharge apparatus 10 according to the first embodiment are changed to lands 70 as shown in FIG. 7. Other portions of the ink discharge apparatus according to the second embodiment are constructed in the same manner as those of the ink discharge apparatus 10. In other words, the lands 52 concerning the first embodiment are formed to be simply circular. On the contrary, the lands 70 concerning the second embodiment are circular, in addition to which lattice-shaped grooves 70*a* are formed. Therefore, according to the ink discharge apparatus concerning the second embodiment, the lands 70 can be easily deformed, because the grooves 70*a* are formed on the lands 70. The lands 70 can be easily extruded toward the ink discharge head 16 as compared with the surroundings thereof, and it is possible to avoid any breakage of the lands 70 at any undesired position. Further, the thermosetting adhesive of the terminals 40 can be allowed to bite into the grooves 70*a*. Therefore, it is possible to widen the contact area between the land 70 and the terminal 40, and it is possible to reliably perform the electrical and physical connection therebetween.

The shape of the grooves 70*a* is not specifically limited. In addition to the lattice-shaped form, it is also allowable to adopt a form of a plurality of concentric circles, and it is also allowable to adopt a form of a plurality of parallel lines. In this embodiment, the grooves 70*a* are not formed as through-hole-shaped slits, and the grooves 70*a* have bottoms. However, it is also allowable to form through-hole-shaped slits in place of the grooves 70*a*.

Third Embodiment

Figure 8:
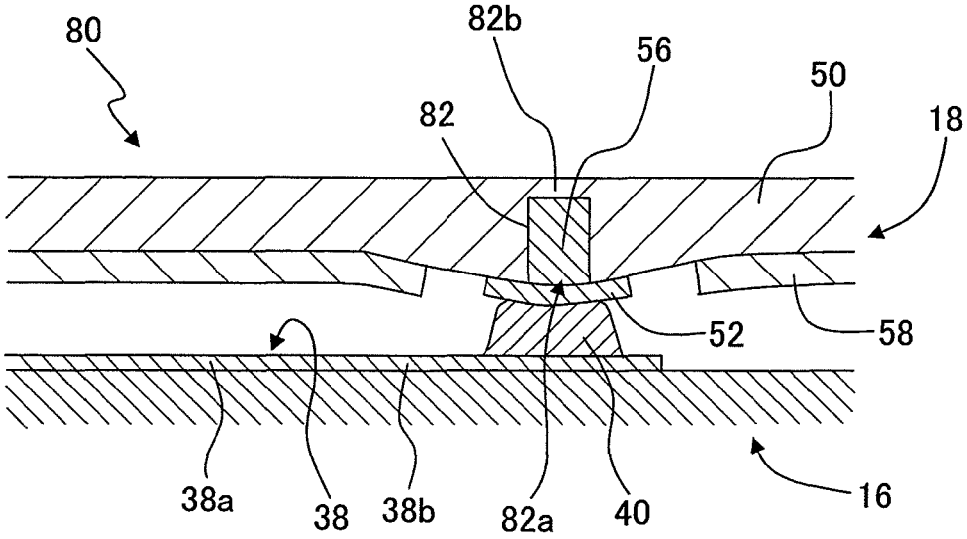
FIG. 8 shows a sectional view illustrating an arrangement of an "ink discharge apparatus" according to a third embodiment.

In an ink discharge apparatus 80 according to a third embodiment as shown in FIG. 8, the through-holes 60, which are formed as the "hollow portions" of the ink discharge apparatus 10 according to the first embodiment, are changed to bottomed holes (bottom-equipped holes) 82. Other portions of the ink discharge apparatus 80 according to the third embodiment are constructed in the same manner as those of the ink discharge apparatus 10. The bottomed hole 82 has an opening 82*a* disposed on the side of the land 52 in relation to the base board 50, and the bottomed hole 82 has a bottom 82*b* disposed on the opposite side. The thermally expandable member 56 is provided in the bottomed hole 82.

The shape or contour of the "hollow portion" is not specifically limited provided that the thermally expandable member 56 can be provided therein. Although not shown, it is also allowable to adopt a "bottomed hole" which has a bottom formed in the base board 50 on the side of the land 52 and which has an opening formed in the base board on the opposite side of the land 52. Alternatively, it is also allowable to adopt a "closed space" in which both end portions in the thickness direction of the base board are closed. Further, the cross-sectional shapes of the "hollow portion" and the thermally expandable member 56 provided therein are not specifically limited, which may be, for example, polygonal shapes and elliptical shapes in addition to the circular shapes.

Fourth Embodiment

Figure 9:
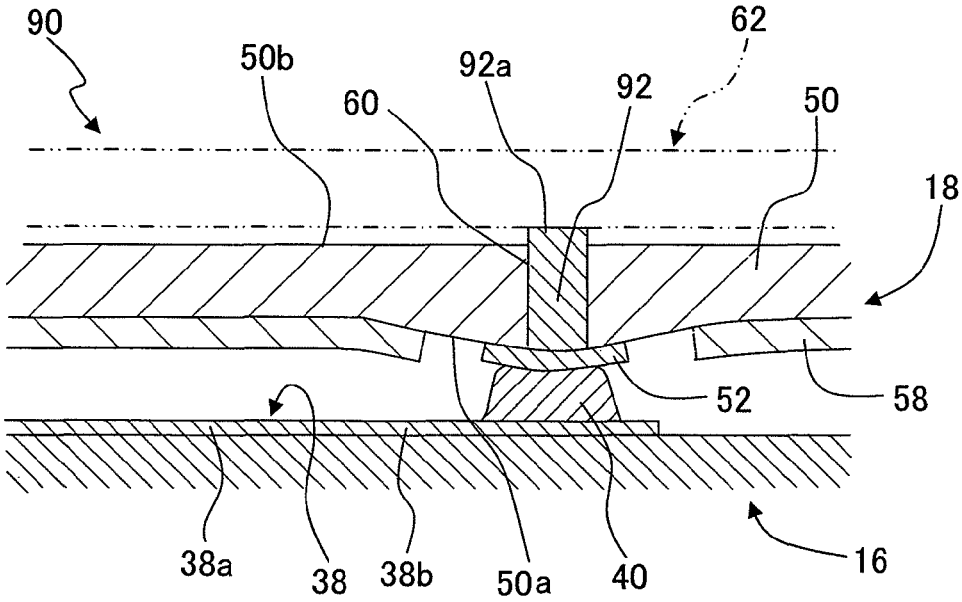
FIG. 9 shows a sectional view illustrating an arrangement of an "ink discharge apparatus" according to a fourth embodiment.

In an ink discharge apparatus 90 according to a fourth embodiment as shown in FIG. 9, the thermally expandable members 56 of the ink discharge apparatus 10 according to the first embodiment are changed to thermally expandable members 92. Other portions of the ink discharge apparatus 90 according to the fourth embodiment are constructed in the same manner as those of the ink discharge apparatus 10. In the ink discharge apparatus 90, the length of the thermally expandable member 92 is longer than the length of the through-hole 60 which is provided as the "hollow portion". The thermally expandable member 92 is arranged in the through-hole 60 in a state of protruding from the surface 50*b* of the base board 50 disposed on the side opposite to the head-facing surface 50*a*. Therefore, when the ink discharge apparatus 90 is produced, the heater 62 can be allowed to abut against end portions 92*a* of the thermally expandable members 92 protruding from the surface 50*b* of the base board 50. The thermally expandable members 92 can be efficiently heated by the heater 62. When the heater 62 is allowed to abut against the end portions 92*a*, the thermally expandable members 92 can be heated in a concentrated manner without heating the base board 50. Therefore, it is not necessarily indispensable that the coefficient of thermal expansion of the thermally expandable member 92 should be greater than the coefficient of thermal expansion of the base board 50.

In the embodiments as described above, the through-hole 60 and the bottomed hole 82 are formed as the holes having the circular cross-sectional areas, wherein the columnar hollow spaces are defined. However, the present teaching is not limited thereto. The shapes of the through-hole 60 and the bottomed hole 82 may be arbitrary. For example, the through-hole 60 and the bottomed hole 82 may have tapered shapes in which the cross-sectional areas are gradually decreased toward the land 52. On the contrary, the through-hole 60 and the bottomed hole 82 may have inverted tapered shapes in which the cross-sectional areas are gradually increased toward the land 52. In the embodiments described above, the thermally expandable members 56, 92 are heated by the heater 62. However, the present teaching is not limited thereto. For example, when the hollow portions in which the thermally expandable members are inserted are formed by the bottomed holes, the thermally expandable members may be heated by an induction heating or an eddy current heating of the bottom portions of the bottomed holes. When the hollow portions are formed by the through holes or when the bottom portions are thin, a board of a magnetic material may be arranged on the base board on a side not facing the inkjet head so that the thermally expandable members is heated by the induction heating of the board of the magnetic material. Alternatively, an energetic beam such as infrared rays and charged particle beams may be irradiated to heat the thermally expandable members, from the side, of the base board, not facing the inkjet head.

In the embodiments as described above, the present teaching is applied to the "ink discharge apparatus" based on the "system in which the ink is discharged by using the pressure generated when the pressure chamber 32 is deformed by the driving section F". However, the present teaching is also applicable to an "ink discharge apparatus" based on the "system in which the ink is discharged by using the pressure generated when the ink is heated". Further, the present teaching is also applicable to any other "liquid discharge apparatus" including, for example, the "coloring liquid discharge apparatus" for discharging the coloring liquid and the "conductive liquid discharge apparatus" for discharging the conductive liquid. When the present teaching is applied, for example, to the "coloring liquid discharge apparatus" and the "conductive liquid discharge apparatus", the "ink" used in the foregoing description is replaced, for example, with the "coloring liquid" and the "conductive liquid".

What is claimed is:

1. A liquid discharge apparatus which discharges a liquid, comprising:

a liquid discharge head including:

a channel unit which is formed with nozzles through which the liquid is discharged and channels for the liquid; and driving sections which have electrodes corresponding to the nozzles and which are driven so that a driving signal is applied to the electrodes to apply a discharge pressure to the liquid in the channel;

bump-shaped terminals which are formed of a conductive material having conductivity and which are arranged on the electrodes; and a wiring board including:

a base board which is arranged to face a surface of the liquid discharge head formed with the electrodes, and in which hollow portions are formed at portions, of the base board, facing the terminals;

thermally expandable members provided in the hollow portions of the base board; and lands which are formed, on a first surface of the base board facing the liquid discharge head, to face the terminals and which cover at least a part of the thermally expandable members, such that the lands are arranged between the thermally expandable members and the terminals;

wherein the terminals are provided at positions shifted from positions overlapped with the driving sections, as viewed in a direction perpendicular to a surface of the liquid discharge head on which the electrodes are formed; and wherein the lands are extruded toward the liquid discharge head, as compared with surroundings of the lands, so that the lands abut against the terminals.

2. The liquid discharge apparatus according to claim 1;

wherein the conductive material is formed of a thermosetting adhesive; and wherein a coefficient of thermal expansion of the thermally expandable member is greater than a coefficient of thermal expansion of the base board.

3. The liquid discharge apparatus according to claim 2;

wherein an increasing ratio of an expansion of the thermally expandable members becomes maximum at a temperature higher than a curing temperature of the thermosetting adhesive.

4. The liquid discharge apparatus according to claim 1;

wherein the hollow portions are formed by through-holes which penetrate through the base board in a thickness direction of the base board.

5. The liquid discharge apparatus according to claim 1;

wherein the hollow portions are formed by bottomed holes which do not penetrate through the base board in a thickness direction of the base board, each of the bottomed hole being defined to have a bottom portion at a second surface, of the base board, disposed on a side opposite to the first surface of the base board and to be open on the first surface.

6. The liquid discharge apparatus according to claim 1, further comprising an insulating layer which covers a portion, of the first surface of the base board, which is different from portions, of the first surface of the base board, in which the lands are formed.

* * * * *